US010662590B1

(12) United States Patent
Biberdorf et al.

(10) Patent No.: US 10,662,590 B1
(45) Date of Patent: May 26, 2020

(54) CONTROL SYSTEM AND METHOD FOR CONTROLLING OPERATION OF AN EDGE FORMING TOOL OF A COMPACTOR

(71) Applicant: Caterpillar Paving Products Inc., Brookyln Park, MN (US)

(72) Inventors: Maria Lynn Biberdorf, Maple Grove, MN (US); Bryan Joseph Downing, Champlin, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 16/242,226

(22) Filed: Jan. 8, 2019

(51) Int. Cl.
*E01C 19/00* (2006.01)
*E01C 19/26* (2006.01)

(52) U.S. Cl.
CPC ..... *E01C 19/268* (2013.01)

(58) Field of Classification Search
CPC ..... E01C 19/268
USPC ..... 404/84.05, 117
See application file for complete search history.

(56) References Cited

U.S. PATENT DOCUMENTS

| | | | |
|---|---|---|---|
| 6,287,048 | B1 | 9/2001 | Hollon et al. |
| 6,755,482 | B2 | 6/2004 | Johnson |
| 7,676,967 | B2 | 3/2010 | Gharsalli et al. |
| 8,424,972 | B2 | 4/2013 | Berning et al. |
| 8,500,363 | B1 | 8/2013 | Ries et al. |
| 8,965,642 | B2 | 2/2015 | Johnson et al. |
| 9,050,725 | B2 | 6/2015 | Shull |
| 2010/0278589 | A1 | 11/2010 | Verhoff |
| 2015/0184347 | A1 | 7/2015 | Lantez et al. |
| 2019/0129379 | A1* | 5/2019 | Norz ..... G05B 19/409 |

FOREIGN PATENT DOCUMENTS

| | | |
|---|---|---|
| JP | 2016223138 | 12/2016 |

* cited by examiner

*Primary Examiner* — Raymond W Addie
(74) *Attorney, Agent, or Firm* — Jeff A. Greene

(57) ABSTRACT

A control system for controlling operation of an edge forming tool associated with a compactor. The control system includes a position sensor for outputting a current position of the edge forming tool relative to a frame of the compactor. The control system further includes a controller disposed in communication with the position sensor. The controller is configured to receive the current position of the edge forming tool from the position sensor. Further, the controller is configured to move the edge forming tool from its current position to a desired position based, at least in part, on the received current position of the edge forming tool.

20 Claims, 4 Drawing Sheets

CONTROL SYSTEM AND METHOD FOR CONTROLLING OPERATION OF AN EDGE FORMING TOOL OF A COMPACTOR

TECHNICAL FIELD

The present disclosure relates to a compactor having an edge forming tool. More particularly, the present disclosure relates to a control system and a method for controlling operation of an edge forming tool of a compactor.

BACKGROUND

It is well known in the art to install an edge forming tool on a compactor to form an edge in a mat of paved material, for example, asphalt. The edge forming tool may be mounted to a frame of the compactor and may include an edge cutting tool or an edge roller depending on specific requirements of an application.

U.S. Pat. No. 8,500,363 discloses a compactor that includes a frame and a compacting element coupled to the frame. In the compactor of the '363 patent, an edge wheel assembly is also coupled to the frame and is adjustable between a raised configuration and a lowered configuration at which an edge wheel contacts a substrate outboard of the compacting element. The compactor of the '363 patent also includes a spray system for the edge wheel, and a control device that is in control communication with the spray system. The control device is configured to command activation of the spray system in response to detecting a lowering of the edge wheel. However, the '363 patent does not disclose a manner in which the control device controls an operation of the edge wheel assembly. It is envisioned that control in the operation of the edge wheel assembly may provide ease to an operator in performing an edge forming operation using the compactor.

Hence, there is a need for a control system and a method for providing control in the operation of the edge forming tool.

SUMMARY OF THE DISCLOSURE

In an aspect of the present disclosure, a control system is provided for controlling operation of an edge forming tool associated with a compactor. The control system includes a position sensor for outputting a current position of the edge forming tool relative to a frame of the compactor. The control system also includes a controller disposed in communication with the position sensor. The controller is configured to receive the current position of the edge forming tool from the position sensor and move the edge forming tool from its current position to a desired position based, at least in part, on the received current position of the edge forming tool.

In another aspect of this disclosure, a compactor includes a frame, and an edge forming tool that is moveably coupled to the frame. The compactor further includes a control system for controlling operation of the edge forming tool. The control system includes a position sensor for outputting a current position of the edge forming tool relative to a frame of the compactor. The control system further includes a controller disposed in communication with the position sensor. The controller is configured to receive the current position of the edge forming tool from the position sensor and move the edge forming tool from its current position to a desired position based, at least in part, on the received current position of the edge forming tool.

In yet another aspect of this disclosure, a method is provided for controlling operation of an edge forming tool that is associated with a compactor. The method includes providing a position sensor for outputting a current position of the edge forming tool relative to a frame of the compactor. The method further includes providing a controller in communication with the position sensor. The method further includes receiving, by the controller, the current position of the edge forming tool from the position sensor. The method further includes moving, by the controller, the edge forming tool from its current position to a desired position based, at least in part, on the received current position of the edge forming tool.

Other features and aspects of this disclosure will be apparent from the following description and the accompanying drawings.

DETAILED DESCRIPTION

Figure 1:
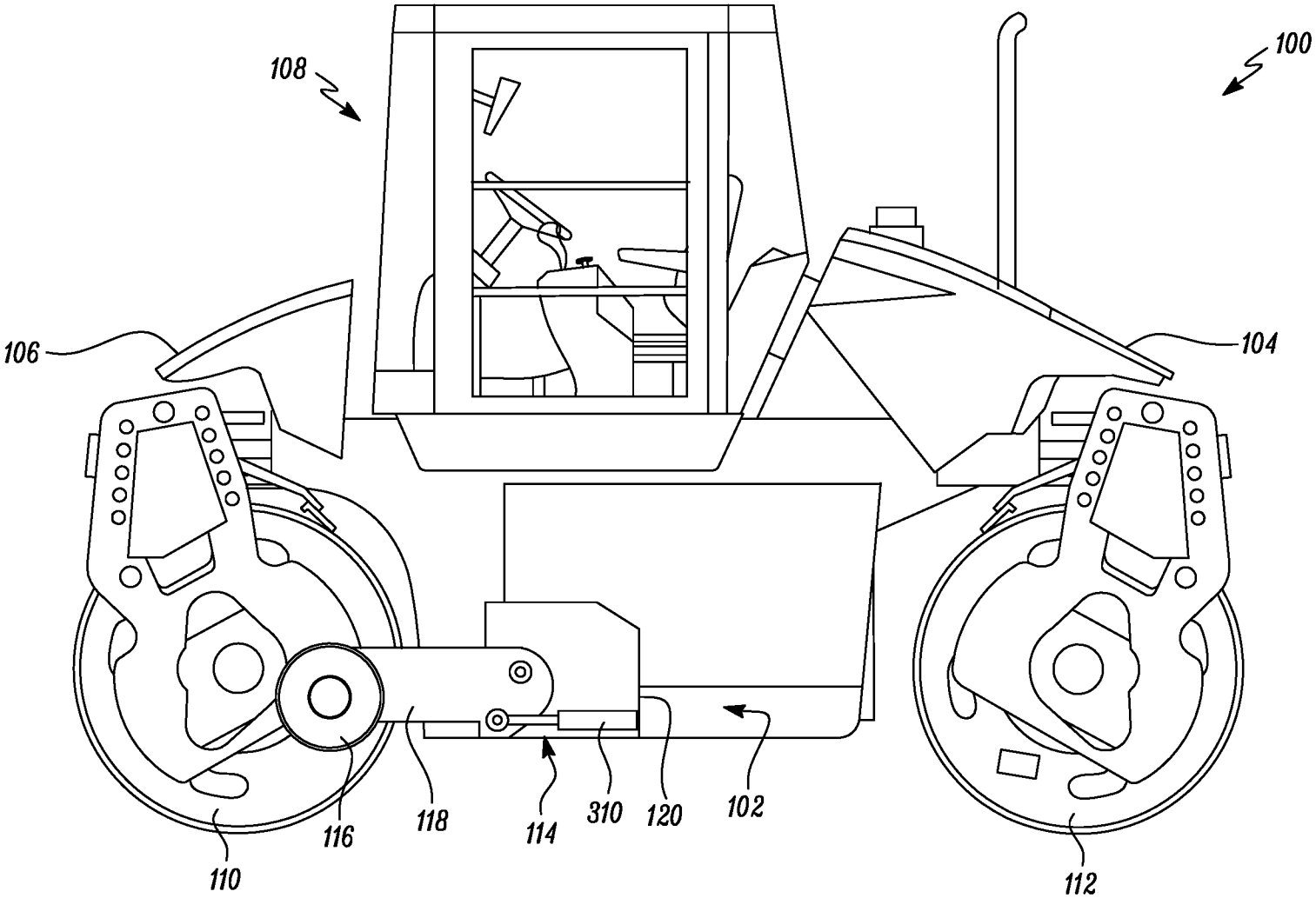
FIG. 1 is a diagrammatic view of a compactor having a frame, an edge forming tool, and a control system for controlling operation of the edge forming tool, in accordance with an embodiment of the present disclosure.

Reference numerals appearing in more than one figure indicate the same or corresponding parts in each of them. References to elements in the singular may also be construed to relate to the plural and vice-versa without limiting the scope of the disclosure to the exact number or type of such elements unless set forth explicitly in the appended claims.

FIG. 1 illustrates a compactor 100 according to an embodiment of the present disclosure. The compactor 100 includes a frame 102. The frame 102 may have a front end 106, a back end 104, and an operator control station 108 positioned between the front end 106 and the back end 104. A pair of rotatable compacting elements 110 and 112 are coupled to the frame 102 and disposed towards the front end 106 and the back end 104 of the frame 102 respectively. Each of the rotatable compacting elements 110, 112 may include a metallic compacting drum. Although metallic compacting drums are disclosed herein, in alternative embodiments, the compactor 100 may employ one or more pneumatic compacting elements or tires in lieu of each metallic compacting drum 110, 112.

The compactor 100 further includes an edge wheel assembly 114. The edge wheel assembly 114 has an edge forming tool 116, and a support arm 118 for moveably coupling the edge forming tool 116 to the frame 102 of the compactor 100. In the illustrated embodiment, only one edge wheel assembly 114 is shown. However, alternative configurations can be contemplated by persons skilled in the art in which as many as four edge wheel assemblies may be used such that two edge assemblies are associated with the each of the compacting elements 110 and 112 respectively.

Optionally, as shown in the illustrated embodiment, the support arm 118 may be mounted to the frame 102 using a bracket 120. Further, the support arm 118 is pivotally connected at its ends to each of the bracket 120 and the edge forming tool 116 respectively. In other embodiments, rather than a pivoting support arm 118, some other type of linkage might be used. For instance, in an alternative embodiment, the support arm 118 may be slidably connected to the frame 102 of the compactor 100 such that the support arm 118 is axially moveable in relation to the frame 102.

Figure 2:
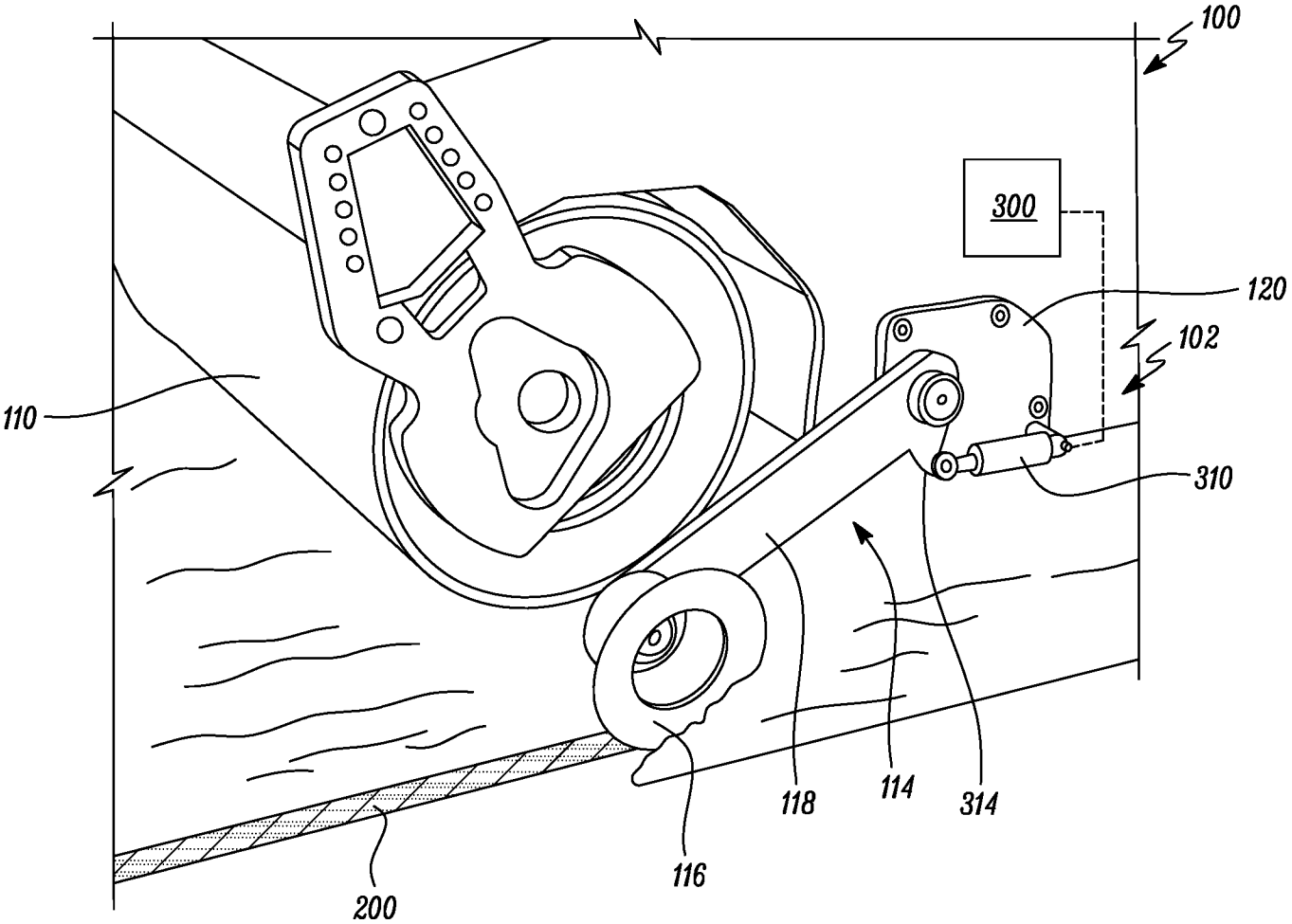
FIG. 2 is a diagrammatic view of a portion of the compactor of FIG. 1, shown with the edge forming tool engaged with a mat of paved material, in accordance with an embodiment of the present disclosure.

Referring now to FIG. 2, there is shown a portion of the compactor 100 in which the edge forming tool 116 has been positioned relative to the frame 102 of the compactor 100 such that the edge forming tool 116 contacts a mat 200 of paved material beneath the compactor 100. In the illustrated embodiment, the edge forming tool 116 is embodied as an edge cutter that is used for cutting an edge in the mat 200 of paved material. In other embodiments, the edge forming tool 116 may be used to selectively broaden a compacting footprint of the compactor 100, cut the mat 200 of paved material beneath the compactor 100 (as shown in FIG. 2), or both.

As shown in the view of FIG. 2, the compactor 100 also has a control system 300 for controlling an operation of the edge forming tool 116. Referring to the view of FIG. 3, a schematic of the control system 300 is depicted in accordance with an embodiment of the present disclosure. As shown, the control system 300 includes a position sensor 302 for outputting a current position of the edge forming tool 116 relative to the frame 102 of the compactor 100. The position sensor 302 may be embodied as a linear or rotary encoder that is configured to provide an analog or digital output signal, the signal being indicative of the current position of the edge forming tool 116 relative to the frame 102. Also, a type of encoder used for forming the position sensor 302 may be either incremental, or preferably, absolute in its measurement technique, although the latter may be preferred over the former as the latter obviates the need for counting the number of measurements taken alongside each measurement itself which is typical in the use of the former type of encoder i.e., the incremental encoder.

The control system 300 also includes a controller 304 disposed in communication with the position sensor 302. The controller 304 is configured to receive the current position of the edge forming tool 116 from the position sensor 302 and move the edge forming tool 116 from its current position to a desired position based, at least in part, on the received current position of the edge forming tool 116.

In embodiments herein, the controller 304 may include various software and/or hardware components that are configured to perform functions consistent with the present disclosure. The controller 304 of the present disclosure may be a stand-alone controller or may be configured to cooperate with an existing electronic control unit (ECU) (not shown) of a machine, for example, the compactor 100.

Further, the controller 304 may embody a single microprocessor or multiple microprocessors that include components for performing functions that are consistent with the present disclosure. Numerous commercially available microprocessors can be configured to perform the functions of the controller 304 disclosed herein. It should be appreciated that the controller 304 could readily be embodied in a general machine microprocessor capable of controlling numerous machine functions. The controller 304 may also include a memory 306 (as shown in the illustrated embodiment of FIG. 3) and any other components for running an application. Various circuits may be associated with the controller 304 such as power supply circuitry, signal conditioning circuitry, solenoid driver circuitry, and other types of circuitry. Also, various routines, algorithms, and/or programs can be stored at the controller 304 for controlling an operation of the edge forming tool 116 i.e., for controlling movement and/or positioning of the edge forming tool 116 relative to the frame 102 based, at least in part on, the current position of the edge forming tool 116 as sensed and output by the position sensor 302.

Figure 3:
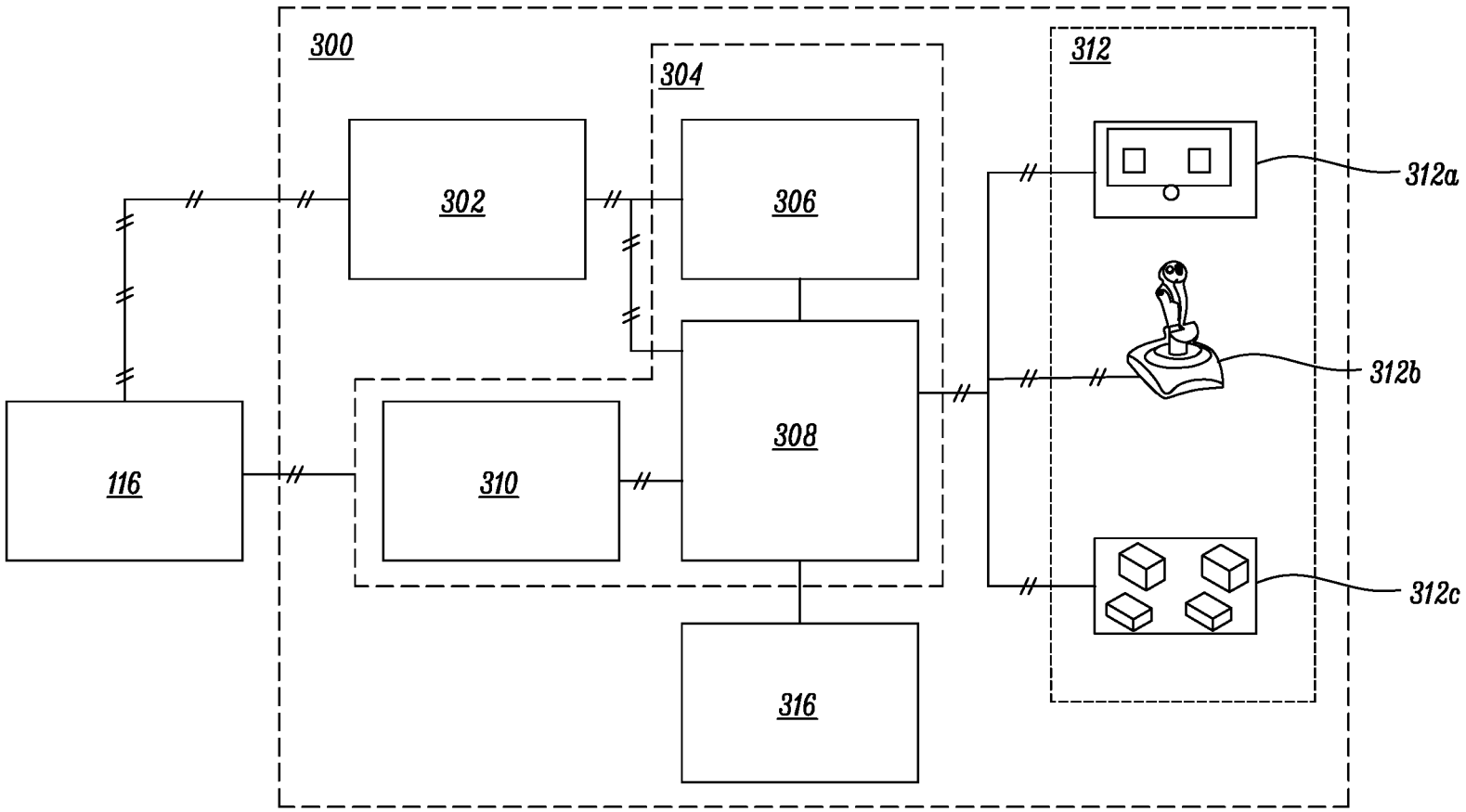
FIG. 3 is a partially schematic view of the control system showing various components of the control system, in accordance with an embodiment of the present disclosure.

In an embodiment as shown in FIG. 3, the controller 304 includes a processor 308 and an actuator 310. The processor 308 is disposed in communication with the position sensor 302. The actuator 310 is disposed in communication with the processor 308 and coupled to the edge forming tool 116. The actuator 310 is configured to actuate movement of the edge forming tool 116 relative to the frame 102.

In the illustrated embodiment of FIGS. 1 and 2, the actuator 310 is embodied as an axially extensible and retractable linear actuator, for example, a pneumatic or hydraulic actuator 310 having a piston and cylinder arrangement. As shown best in the view of FIG. 2, the linear actuator is coupled at its ends to the bracket 120 and a crank 314 extending from a lower side of the support arm 118. Accordingly, extension of the linear actuator causes the edge forming tool 116 to move away from the mat 200 while retraction of the linear actuator causes the edge forming tool 116 to move towards the mat 200. Using alternative arrangements of the linear actuator and the crank, converse is possible where extension of the linear actuator causes the edge forming tool 116 to move towards the mat 200 while retraction of the linear actuator causes the edge forming tool 116 to move away from the mat 200. Although the foregoing discloses an arrangement of the edge wheel assembly 114 with the linear actuator and the crank, in other embodiments, a rotary actuator 310 having or employing one or more rotatable elements may be used in lieu of the linear actuator and crank arrangement for moving the edge forming tool 116 relative to the frame 102. The rotary actuator 310 disclosed herein may include, but is not limited to, an engine or an electric motor (not shown) of the compactor 100, while the rotatable elements may include, but are not limited to, a drive shaft, a belt and pulley system, and/or a gear drive system.

Referring again to the schematic of FIG. 3, the control system 300 may further include at least one user input device 312 in communication with the controller 304. The at least one user input device 312 may be operable for providing at least one type of input to the controller 304 for moving the edge forming tool 116 from its current position to the desired position. As shown in the illustrated embodiment, the at least one user input device 312 includes three user input devices 312*a*, 312*b*, and 312*c*. However, in alternative embodiments, fewer or more input devices may be implemented for use in lieu of the three user input devices 312*a*, 312*b*, and 312*c* disclosed herein.

In the illustrated embodiment of FIG. 1, the user input device 312*a* may be implemented via a Graphical User Interface (GUI) provided on one or more pixel displays. Beneficially, at least one pixel display from these pixel displays may be implemented as at least one touch-screen display for allowing an operator to operably provide at least one type of input to the controller 304. Additionally, or optionally, the GUI, or a part of the GUI, may be implemented via a portable device (not shown) that includes at least one touch-screen display, touch buttons and/or physical buttons.

Further, the user input device 312*b* may be implemented via a joystick control having a moveable control lever and control switches mounted thereon. The joystick disclosed herein may be a stand-alone joystick i.e., the joystick may be designated for use in controlling an operation of the edge forming tool 116 alone. Alternatively, the joystick may be integrated with additional functionality that extends to control other components of the compactor 100 in addition to controlling operation of the edge forming tool 116.

Furthermore, the user input device 312*c* may be implemented via a control module having physical push buttons, a slider, or moveable elements mounted thereon that are operable for controlling an operation of the edge forming tool 116. It may be noted that a type of user input device used is non-limiting of this disclosure. With regard to the illustrated embodiment of FIG. 3, each type of user input device 312*a*, 312*b*, and 312*c* can be used independent of, or in combination with, one another to perform functions that are consistent with the present disclosure.

The at least one type of user input operably provided by the input device 312 includes a primary input. The primary input is indicative of a mode of operation selected from a plurality of modes of operation for the controller 304. In an embodiment, the primary input, provided as a selected mode of operation, may include a manually adjustable mode i.e., the operator may operatively provide the primary input manually adjustable mode as the selected mode of operation via the user input device 312. In the manually adjustable mode, the controller 304 may be configured to move the edge forming tool 116 in relation to the frame 102 based on a secondary input provided to the controller 304. This secondary input is also operably provided from the user input device 312, for example, the user input device 312*b* that is embodied as the joystick. This secondary input may be indicative of the desired position of the edge forming tool 116. Corresponding to, for example, a speed and magnitude of the joystick, the controller 304 may move the edge forming tool 116 to the desired position in relation to the frame 102.

In another embodiment, the primary input, provided as a selected mode of operation, may include a kick-out mode i.e., the operator may operatively select the kick-out mode via the user input device 312. Once the kick-out mode is selected, the user input device 312, for example, the user input device 312*b* i.e., the joystick may be moved by the operator from its neutral position to a position corresponding with the position of the edge forming tool 116 desired by the operator. This desired position of the edge forming tool 116 may now be defined i.e., stored in the memory 306, for example, by a long-press of a physical switch located on the joystick, the long-press being of a duration not less than 3 seconds or another pre-defined amount of time depending on specific requirements of an application.

Upon storing the desired position of the edge forming tool 116 in the memory 306 of the controller 304, in a subsequent period of time, the operator may merely need to issue a kick-out command, for example, by momentarily pressing the physical switch i.e., by a short-press of the physical switch present on the joystick lasting for a duration of about 1 second or less so that the controller 304 reads such previously stored position i.e., the pre-defined desired position of the edge forming tool 116 from the memory 306 and commands the actuator 310 to move the edge forming tool 116 corresponding to such pre-defined desired position.

In another embodiment, the primary input, provided as a selected mode of operation, may include an autonomous mode i.e., the operator may operatively select the autonomous mode via the user input device 312. Once the autonomous mode is selected, the controller 304 is configured to determine the desired position of the edge forming tool 116 as a function of the current position of the edge forming tool 116 and a depth of the mat 200 comprising paved material, and move the edge forming tool 116 from its current position into the desired position as determined by the controller 304. For obtaining the depth of the mat 200 of paved material, in an embodiment, the control system 300 may further include a depth sensor 316 located onboard one of the compactor 100 and another machine (not shown), for example, a screed paver that is typically used for paving operation. This depth sensor 316 may be disposed in communication with the controller 304 for outputting a signal indicative of the depth of the mat 200 to the controller 304. If located on a machine other than the compactor 100, the depth sensor 316 may preferably be disposed in wireless communication with the controller 304.

The function disclosed herein may be pre-set at the controller 304 and may have at least one pre-defined logic therein. For instance, the function may be stored in the memory 306 as a look-up table that can be accessed by the processor 308 for determination of the desired position and may include pre-calculated tables and/or curves that may be representative of various theoretical models, logical, analytical, statistical, simulated models, or other test and/or experimental data pertaining to the computation of the desired position of the edge forming tool 116.

Figure 4:
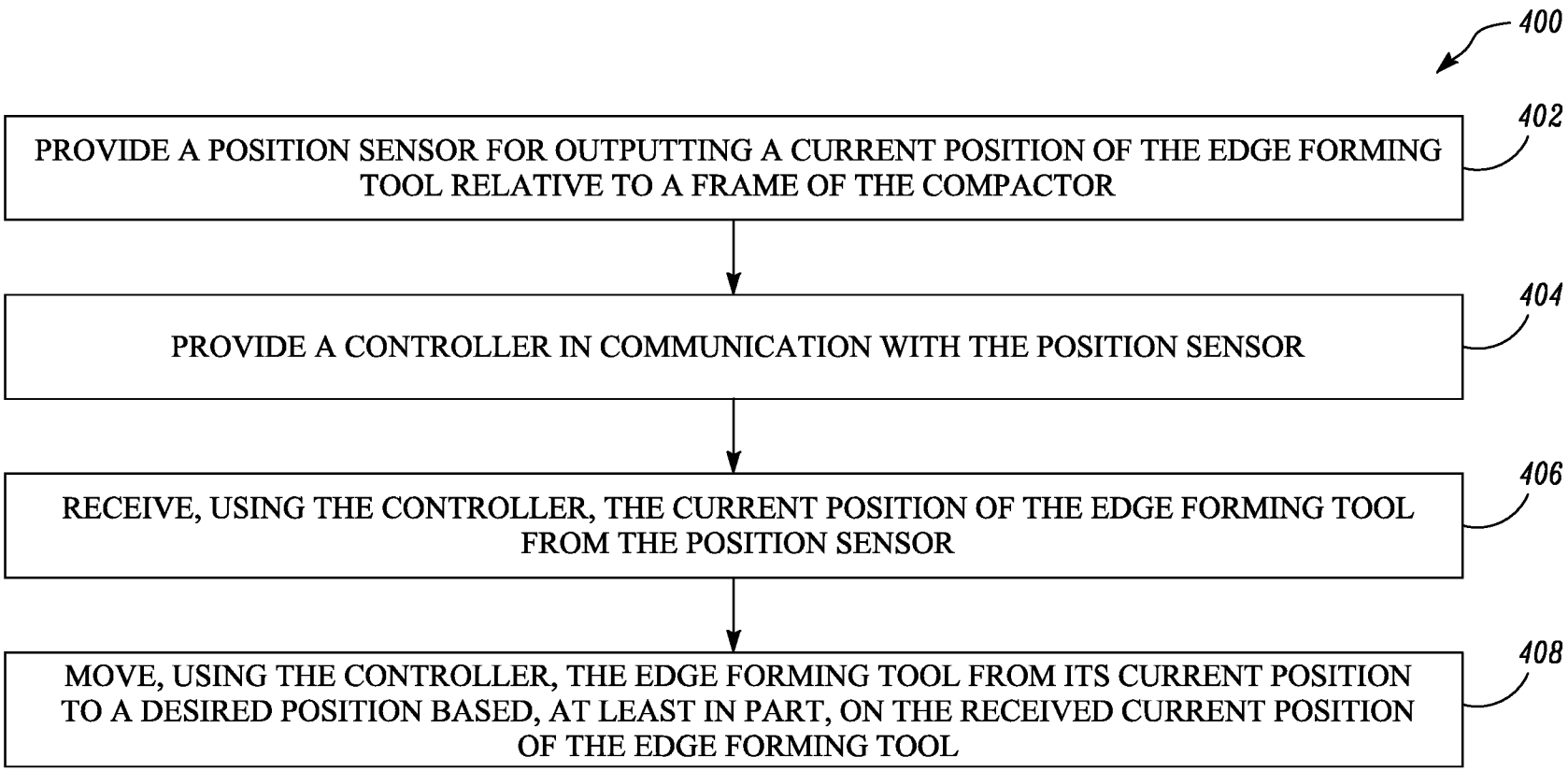
FIG. 4 is a flowchart depicting steps of a method for controlling operation of the edge forming tool, in accordance with an embodiment of the present disclosure.

FIG. 4 illustrates a method 400 for controlling operation of an edge forming tool 116, for example, the edge forming tool 116 associated with the compactor 100, in accordance with an embodiment of the present disclosure. At step 402, the method 400 includes providing a position sensor 302 for outputting a current position of the edge forming tool 116 relative to a frame 102 of the compactor 100. At step 404, the method 400 further includes providing a controller 304 in communication with the position sensor 302. At step 406, the method 400 further includes receiving, by the controller 304, the current position of the edge forming tool 116 from the position sensor 302. At step 408, the method 400 further includes moving, by the controller 304, the edge forming tool 116 from its current position to a desired position based, at least in part, on the received current position of the edge forming tool 116.

Various embodiments disclosed herein are to be taken in the illustrative and explanatory sense and should in no way be construed as limiting of the present disclosure. All joinder references (e.g., associated, provided, connected, coupled and the like) are only used to aid the reader's understanding of the present disclosure, and may not create limitations, particularly as to the position, orientation, or use of the systems and/or methods disclosed herein. Therefore, joinder references, if any, are to be construed broadly. Moreover, such joinder references do not necessarily infer that two elements are directly connected to each other.

Additionally, all numerical terms, such as, but not limited to, "first", "second", or any other ordinary and/or numerical terms, should also be taken only as identifiers, to assist the reader's understanding of the various elements, embodiments, variations and/or modifications of the present disclosure, and may not create any limitations, particularly as to the order, or preference, of any element, embodiment, variation and/or modification relative to or over another element, embodiment, variation and/or modification.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

With implementation of the embodiments disclosed herein, manufacturers of compactors can provide a control system for controlling operation of one or more edge forming tools of the compactor. Using the control system 300 of the present disclosure, operators can choose between at least three modes of operation, namely, the manually adjustable mode, the kick-out mode, and the autonomous mode depending on a level of convenience and ease desired by the operator and based on other specific requirements of an application.

With implementation of the control system 300 in compactors, edge forming operation may, for instance, in cases of high variability be carried out in the manually adjustable mode in which an operator has adequate flexibility to control the edge forming tool 116 by manually taking into consideration the high variability. In other cases, for instance, where moderate to high variability is encountered, operators may choose the kick-out mode of operation. The kick-out mode may help reduce operator fatigue by allowing operators to cycle the edge forming tool 116 between positions of engagement and disengagement with the mat 200 of paved material. In yet other cases, for instance, where low to moderate variability is encountered, operators may choose the autonomous mode of operation. The autonomous mode may help further reduce operator fatigue by removing manual intervention altogether and allowing the controller 304 to determine the desired position of the edge forming tool 116 as a function of the current position of the edge forming tool 116 and a depth of the mat 200. Thereafter, the controller 304 may move the edge forming tool 116 from its current position into the desired position as determined earlier by the controller 304.

While aspects of the present disclosure have been particularly shown and described with reference to the embodiments above, it will be understood by those skilled in the art that various additional embodiments may be contemplated by the modification of the disclosed machines, systems, methods and processes without departing from the spirit and scope of what is disclosed. Such embodiments should be understood to fall within the scope of the present disclosure as determined based upon the claims and any equivalents thereof.

What is claimed is:

1. A control system for controlling operation of an edge forming tool associated with a compaction roller, the control system comprising:

a position sensor for outputting a current position of the edge forming tool relative to a frame of the compactor;

a controller disposed in communication with the position sensor, the controller configured to:

receive the current position of the edge forming tool from the position sensor; and move the edge forming tool from its current position to a desired position based, at least in part, on the received current position of the edge forming tool.

2. The control system of claim 1 further comprising at least one user input device in communication with the controller, wherein the user input device is operable for providing at least one type of input to the controller for moving the edge forming tool from its current position to the desired position.

3. The control system of claim 2, wherein the at least one type of user input includes a primary input, the primary input indicative of a mode of operation selected from a plurality of modes of operation for the controller.

4. The control system of claim 3, wherein the mode of operation includes one of:

a manually adjustable mode, wherein the controller is configured to move the edge forming tool in relation to the frame based on a secondary input provided to the controller, the secondary input operably provided from the user input device and indicative of the desired position of the edge forming tool;

a kick-out mode, wherein the desired position of the edge forming tool is pre-defined by a user using the user input device and preset at the controller, and in response to a kick-out command provided to the controller by the user input device, the controller moves the edge forming tool into the pre-defined desired position; and an autonomous mode, wherein the controller is configured to:

determine the desired position of the edge forming tool as a function of the current position of the edge forming tool and a depth of a mat comprising paved material, the function being pre-set at the controller and having at least one pre-defined logic therein; and move the edge forming tool from its current position into the desired position as determined by the controller.

5. The control system of claim 4, wherein the control system further includes a depth sensor located onboard one of: the compaction roller and another machine, the depth sensor disposed in communication with the controller for outputting a signal indicative of the depth of the mat to the controller.

6. The control system of claim 5, wherein the controller includes:

a processor in independent communication with the position sensor and the depth sensor; and an actuator disposed in communication with the processor and coupled with the edge forming tool, the actuator configured to actuate movement of the edge forming tool relative to the frame.

7. The control system of claim 6, wherein the actuator is one of a rotary actuator and a linear actuator.

8. A compaction roller comprising:

a frame;

an edge forming tool moveably coupled to the frame; and a control system for controlling operation of the edge forming tool, the control system comprising:

a position sensor for outputting a current position of the edge forming tool relative to a frame of the compactor;

a controller disposed in communication with the position sensor, the controller configured to:

receive the current position of the edge forming tool from the position sensor; and move the edge forming tool from its current position to a desired position based, at least in part, on the received current position of the edge forming tool.

9. The compaction roller of claim 8, wherein the compactor is one of a drum compactor and a pneumatic compactor.

10. The compaction roller of claim 8 further comprising a user input device in communication with the controller, wherein the user input device is operable for providing at least one type of input to the controller for moving the edge forming tool from its current position to the desired position.

11. The compaction roller of claim 10, wherein the at least one type of user input includes a primary input, the primary input indicative of a mode of operation selected from a plurality of modes of operation for the controller.

12. The compaction roller of claim 11, wherein the mode of operation includes one of:

a manually adjustable mode, wherein the controller is configured to move the edge forming tool in relation to the frame based on a secondary input provided to the controller, the secondary input indicative of the desired position of the edge forming tool;

a kick-out mode, wherein the desired position of the edge forming tool is pre-defined by a user and preset at the controller, and in response to a kick-out command provided to the controller, the controller moves the edge forming tool into the pre-defined desired position; and an autonomous mode, wherein the controller is configured to:

determine the desired position of the edge forming tool as a function of the current position of the edge forming tool and a depth of a mat comprising paved material, the function being pre-set at the controller and having at least one pre-defined logic therein; and move the edge forming tool from its current position into the desired position as determined by the controller.

13. The compaction roller of claim 8, wherein the control system further includes a depth sensor located onboard one of: the compactor and another machine, the depth sensor disposed in communication with the controller for outputting a signal indicative of the depth of the mat to the controller.

14. The compaction roller of claim 13, wherein the controller includes:

a processor in independent communication with the position sensor and the depth sensor; and an actuator disposed in communication with the processor and the edge forming tool, the actuator configured to actuate movement of the edge forming tool relative to the frame.

15. The compaction roller of claim 14, wherein the actuator is one of a rotary actuator and a linear actuator.

16. A method for controlling operation of an edge forming tool associated with a compaction roller, the method comprising:

providing a position sensor for outputting a current position of the edge forming tool relative to a frame of the compactor;

providing a controller in communication with the position sensor;

receiving, by the controller, the current position of the edge forming tool from the position sensor; and moving, by the controller, the edge forming tool from its current position to a desired position based, at least in part, on the received current position of the edge forming tool.

17. The method of claim 16 further comprising providing a user input device in communication with the controller, the user input device operable for providing at least one type of input to the controller for moving the edge forming tool from its current position to the desired position.

18. The method of claim 17 further comprising providing a primary input via the user input device, the primary input indicative of a mode of operation selected from a plurality of modes of operation for the controller.

19. The method of claim 18, wherein selecting the mode of operation includes selecting one of:

a manually adjustable mode, wherein the controller is configured to move the edge forming tool in relation to the frame based on a secondary input provided to the controller, the secondary input indicative of the desired position of the edge forming tool;

a kick-out mode, wherein the desired position of the edge forming tool is pre-defined by a user and preset at the controller, and in response to a kick-out command provided to the controller, the controller moves the edge forming tool into the pre-defined desired position; and an autonomous mode, wherein the controller is configured to:

determine the desired position of the edge forming tool as a function of the current position of the edge forming tool and a depth of a mat comprising paved material, the function being pre-set at the controller and having at least one pre-defined logic therein; and move the edge forming tool from its current position into the desired position as determined by the controller.

20. The method of claim 19 further comprising providing a depth sensor onboard one of: the compactor and another machine, wherein the depth sensor disposed in communication with the controller for outputting a signal indicative of the depth of the mat to the controller.

* * * * *